US008425002B2

(12) United States Patent
Izuchi

(10) Patent No.: US 8,425,002 B2
(45) Date of Patent: Apr. 23, 2013

(54) IMAGE RECORDING DEVICES

(75) Inventor: Masatoshi Izuchi, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1012 days.

(21) Appl. No.: 11/952,791

(22) Filed: Dec. 7, 2007

(65) Prior Publication Data

US 2008/0158290 A1 Jul. 3, 2008

(30) Foreign Application Priority Data

Dec. 28, 2006 (JP) ..... 2006-353985

(51) Int. Cl.
*B41J 2/165* (2006.01)

(52) U.S. Cl.
USPC ..... 347/34

(58) Field of Classification Search ..... 347/33–34
See application file for complete search history.

(56) References Cited

U.S. PATENT DOCUMENTS

| | | | | |
|---|---|---|---|---|
| 6,454,385 | B1 * | 9/2002 | Anderson et al. | 347/28 |
| 6,652,086 | B1 * | 11/2003 | Tomida et al. | 347/101 |
| 7,182,446 | B2 | 2/2007 | Usui et al. | |
| 7,325,918 | B2 * | 2/2008 | Silverbrook | 347/104 |
| 2004/0041860 | A1 * | 3/2004 | Takahashi et al. | 347/8 |
| 2005/0088497 | A1 | 4/2005 | Katayama et al. | |
| 2005/0140749 | A1 | 6/2005 | Usui et al. | |
| 2005/0146577 | A1 | 7/2005 | Sasaki et al. | |
| 2006/0125888 | A1 | 6/2006 | Kanbe | |
| 2008/0093199 | A1 * | 4/2008 | Reynebeau et al. | 198/496 |

FOREIGN PATENT DOCUMENTS

| | | | |
|---|---|---|---|
| JP | 56056894 A | * | 5/1981 |
| JP | 2003300330 A | | 10/2003 |
| JP | 2005238576 A | | 9/2005 |
| JP | 2006015659 A | | 1/2006 |

* cited by examiner

*Primary Examiner* — Ryan Lepisto
*Assistant Examiner* — Erin Chiem
(74) *Attorney, Agent, or Firm* — Baker Botts L.L.P.

(57) ABSTRACT

An image recording device includes a recording head comprising a plurality of nozzles configured to dispense ink onto a recording medium when the recording medium is conveyed in a sub-scanning direction, and a carriage configured to reciprocate in a main scanning direction perpendicular to the sub-scanning direction, in which the recording head is positioned on the carriage and moves with the carriage. The image recording device also includes a cleaning unit positioned within the carriage. The cleaning unit is positioned at a more upstream side in the sub-scanning direction than the plurality of nozzles are positioned in the sub-scanning direction, and the cleaning unit includes a cleaning member. Moreover, the cleaning member is configured to move between a first position in which the cleaning member is in contact with a surface of the recording medium, and a second position in which the cleaning member is separated from the surface of the recording medium.

11 Claims, 12 Drawing Sheets

IMAGE RECORDING DEVICES

CROSS-REFERENCE TO RELATED APPLICATION

The present application claims priority from Japanese Patent Application Publication No. JP-2006-353985, which was filed on Dec. 28, 2006, the disclosure of which is incorporated herein by reference in its entirety.

BACKGROUND OF THE INVENTION

1. Field of the Invention

The present application relates generally to an image recording device in which debris, such as dust, e.g., a recording medium powder, is removed from a surface of a recording medium before the image recording apparatus records an image on the recording medium.

2. Description of Related Art

A known inkjet type image recording device may include a carriage configured reciprocate in a main scanning direction, and a recording head mounted to and supported by the carriage. In operation, a plurality of recording medium, such as paper, may be sequentially and intermittingly conveyed in a sub-scanning direction perpendicular to the main scanning direction, and images may be recorded onto the conveyed recording medium.

In the known inkjet type image recording device, if debris, such as dust, e.g., a recording medium powder, is positioned on a surface of the recording medium when ink is ejected onto the recording medium, the ejected ink may adhere to the debris instead of adhering to the recording medium, and when the debris subsequently disengages from the recording medium, the ejected ink also may disengage from the recording medium, which may create white specks within in the image.

In general, the known inkjet type image recording device may be configured to perform two types of image recordings. Specifically, the known inkjet type image recording device may be configured to record text data and to record photograph data. With respect to recording text data, the recording head generally ejects ink droplets having a relatively large volume of ink. Such ink droplets are likely to contact the recording medium before the ink droplets transform from a liquid into a mist. This allows a distance between a nozzle surface and the recording medium, e.g., a paper gap or a printing gap, to be greater than a predetermined distance. In this case, an area of the recording medium which the ink droplets occupy corresponds to a relatively small percentage of the total area of the recording medium. Consequently, even if debris on the recording medium subsequently disengages from the recording medium, the quality of the recording medium may not be substantially affected.

Nevertheless, with respect to photograph data, the recording head generally ejects ink droplets having a relatively small volume of ink. Such ink droplets may transform from a liquid into a mist before the ink droplets contact the recording medium if the distance between the nozzle surface and the recording medium is greater than the predetermined distance. Therefore, it is desirable to minimize the distance between the nozzle surface and the recording medium. In the known inkjet type image recording device, if the distance between the nozzle surface and the recording medium is minimized, e.g., to be less than the predetermined distance, and debris on the recording medium subsequently disengages from the recording medium, the quality of the recording medium may be substantially affected.

Moreover, in the known inkjet type image recording device, if the distance between the nozzle surface and the recording medium is minimized, e.g., to be less than the predetermined distance, debris which rises from the surface of the recording medium into air which is between the recording medium and the nozzles may adhere to the nozzles, which may alter a trajectory of the ink, and thereby decrease the quality of the image.

SUMMARY OF THE INVENTION

Therefore, a need has arisen for image recording devices which overcome these and other shortcomings of the related art. A technical advantage of the present invention is that debris, such as dust, e.g., a recording medium powder, is removed from a surface of a recording medium before the image recording apparatus records an image on the recording medium.

According to an embodiment of the present invention, an image recording device comprises a recording head comprising a plurality of nozzles configured to dispense ink onto a recording medium when the recording medium is conveyed in a sub-scanning direction, and a carriage configured to reciprocate in a main scanning direction perpendicular to the sub-scanning direction, in which the recording head is positioned on the carriage and moves with the carriage. The image recording device also comprises a cleaning unit positioned within the carriage. The cleaning unit is positioned at a more upstream side in the sub-scanning direction than the plurality of nozzles are positioned in the sub-scanning direction, and the cleaning unit comprises a cleaning member. Moreover, the cleaning member is configured to move between a first position in which the cleaning member is in contact with a surface of the recording medium, and a second position in which the cleaning member is separated from the surface of the recording medium.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

DETAILED DESCRIPTION OF THE EMBODIMENT

Embodiments of the present invention and their features and technical advantages may be understood by referring to FIGS. 1-9D, like numerals being used for like corresponding parts in the various drawings.

An image recording device, such as a multi-function device 1, may be configured to perform a plurality of functions, such as printing, copying, scanning, and facsimile functions. The multi-function device 1 may be connected to a computer and may be configured to record an image or text, or both, onto a recording medium P, such as paper, based on image data or text data, or both, transmitted from the computer. The multi-function device 1 also may be connected to an external device, such as a digital camera, and may be configured to record image data outputted from the digital camera onto the recording medium.

Figure 1:
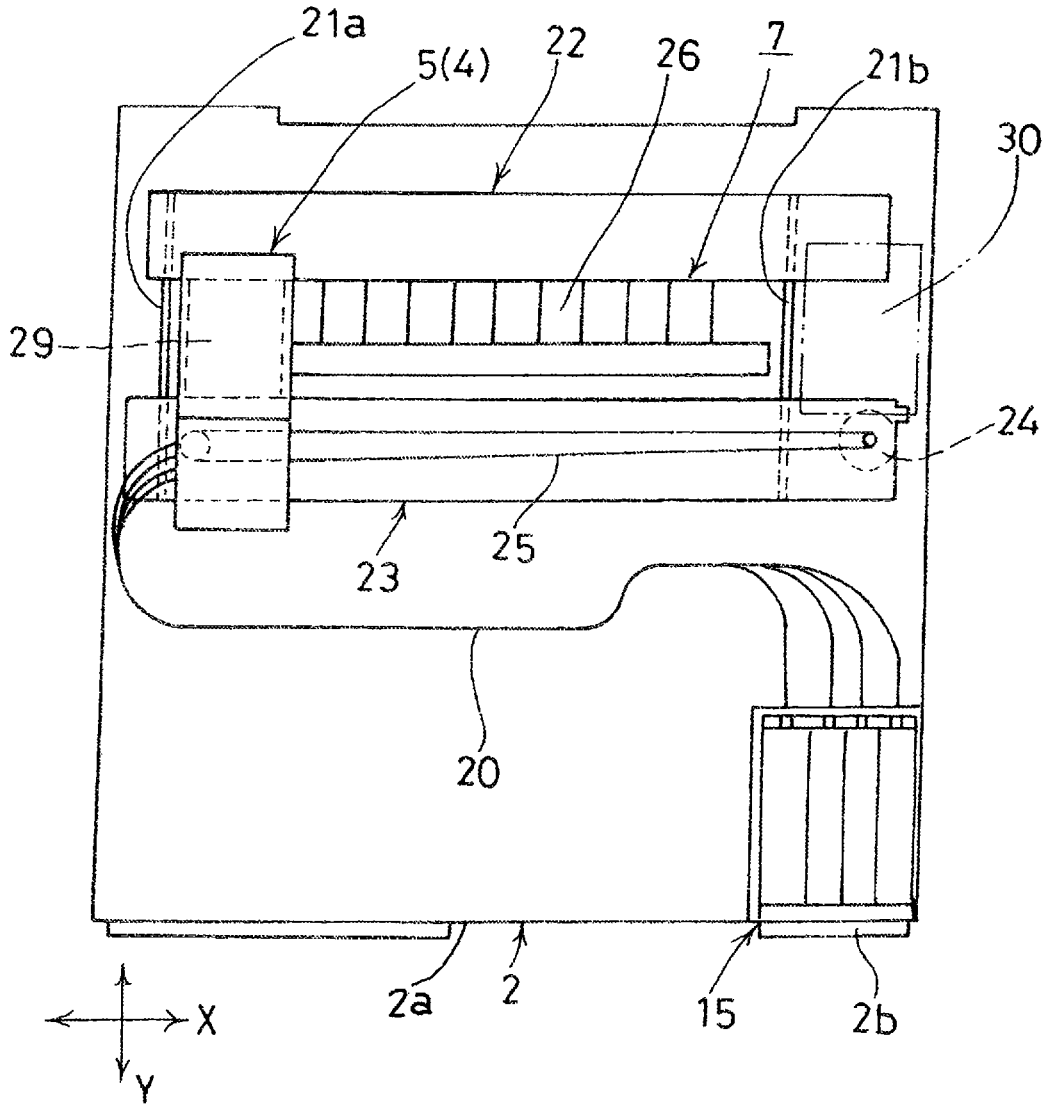
FIG. 1 is a plan view of an image recording device, without an image reading device, according to an embodiment of the present invention.
Figure 2:
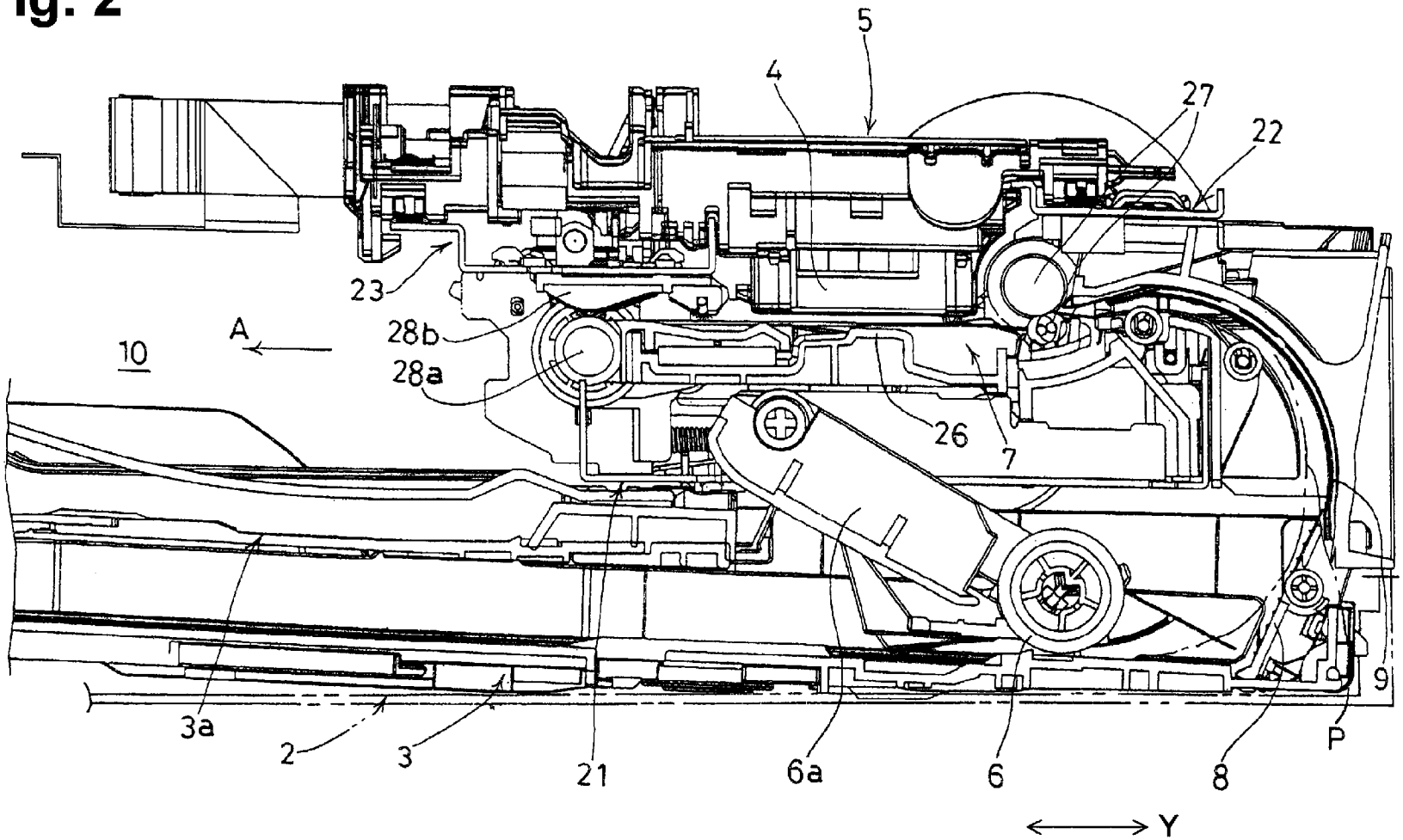
FIG. 2 is a partially cutout sectional view of a recording unit comprising a and sheet cassette, according to an embodiment of the present invention.

Referring to FIGS. 1 and 2, a recording unit 7, e.g., a printing unit, may be positioned at a lower portion of a housing 2, and the housing 2 may comprise a synthetic resin. A sheet cassette 3 may be positioned at a sheet cassette storing portion of housing 2, and may be removable from housing 2 via an insertion opening 2*a* which is open with respect to a front of the housing 2.

An image reading device, such as a scanning unit (not shown), may be positioned at an upper portion of the housing 2. The image reading device may be configured to read an image from the recording medium, and the multi-function device 1 may be configured to copy the image or transmit a facsimile comprising the image, or both.

The multi-function device 1 also may comprise an operation panel (not shown) comprising a plurality of operation buttons and a liquid crystal display (LCD). The LCD may be positioned at the front of the scanning unit at the upper portion of the housing 2. The recording unit 7 and a discharge portion 10 may be positioned underneath the operation panel and the image reading device. A cartridge storing unit 15 may be formed in the front of the housing 2 at one side of the discharge portion 10. A front of the cartridge storing unit 15 may be covered by a cover 2*b*. The cover 2*b* may be vertically pivotable about its lower end via a plurality of hinges. The cover 2*b* may be configured to tilt downward to expose the cartridge storing unit 15 via an opening at the front of the housing 2, and may be raised upright to cover the opening.

Referring to FIG. 2, a recording medium P, such as an A4 size recording medium, a letter size recording medium, a legal size medium, or the like, may be stored with their shorter sides perpendicular to a sheet conveying direction, e.g., a Y-axis direction.

An auxiliary cassette 3*a* for relatively small sized recording medium may be mounted on the sheet cassette 3. The auxiliary cassette 3*a* may be movable in the Y-axis direction.

An inclined separation plate 8 may be configured to separate and to convey recording medium from the rest of the recording medium, and may be positioned at a rear of the sheet cassette 3. An arm 6*a* may be attached to the housing 2, and may be vertically pivotable about its upper end. A sheet feed roller 6 may be positioned at a lower end of the arm 6*a* and may operate in cooperation with the inclined separation plate 8 to sequentially separate and feed the recording medium P stacked in the sheet cassette 3 or the auxiliary cassette 3*a*. When a recording medium P is separated from the recording medium P stacked in the sheet cassette 3 or the auxiliary cassette 3*a*, the separated recording medium may be fed via a sheet conveying path 9, e.g., a U-shaped conveying path, to the recording unit 7. The recording unit 7 may comprise a carriage 5 which is configured to reciprocate in a main scanning direction, e.g., an X-axis, and an inkjet type recording head 4 may be positioned on, e.g., mounted to, the carriage 5, such that the recording head 4 is configured to move with the carriage 5.

The discharge portion 10 may be formed above the auxiliary cassette 3*a*. The recording medium P on which an image has been recorded by the recording unit 7 may be discharged into the discharge portion 10 with its recording surface facing in an upwards direction. A discharge opening continuing to the discharge portion 10 may be open frontward of the housing 2.

Figure 3:
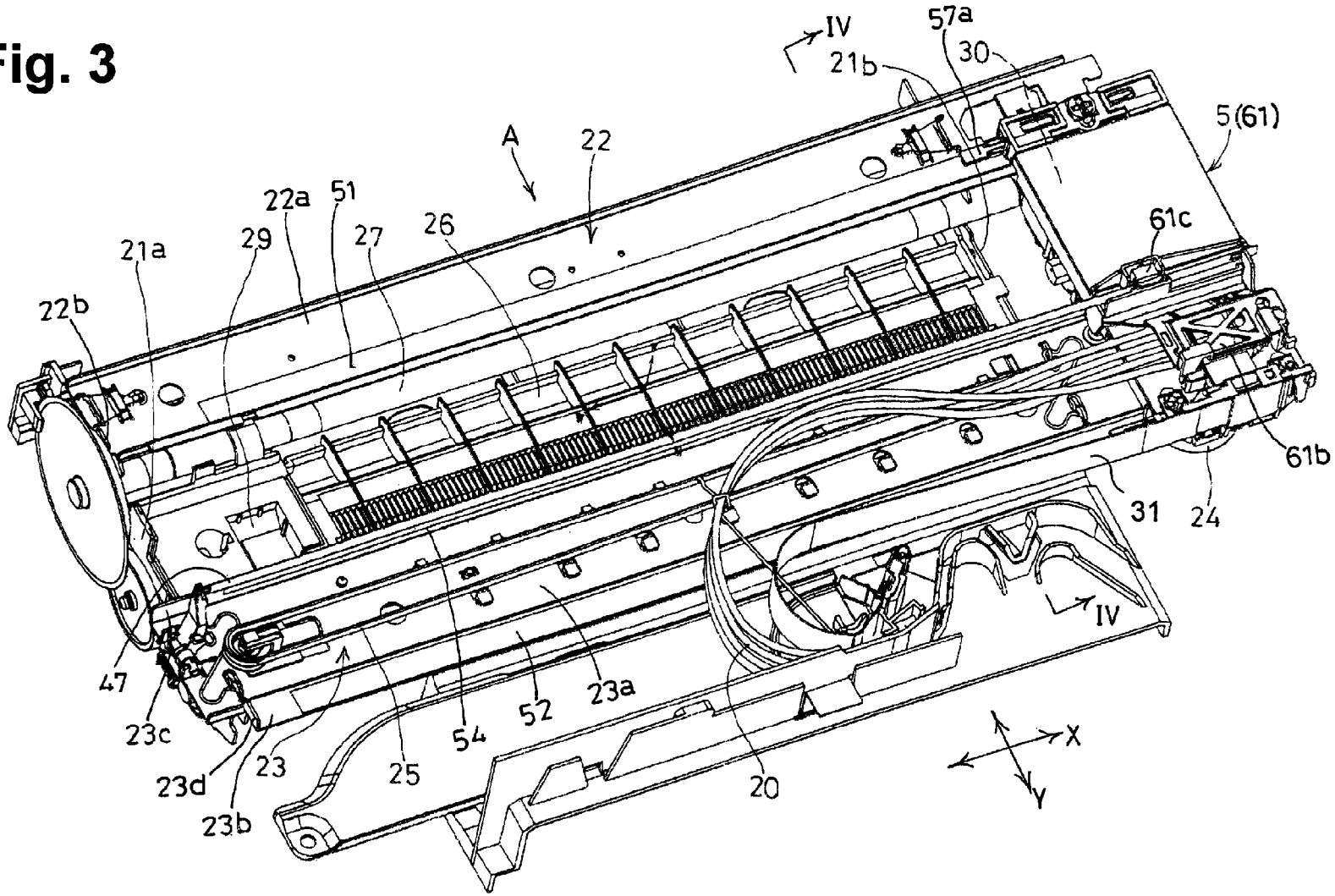
FIG. 3 is a perspective view of the recording unit of FIG. 2.

Referring to FIGS. 1-3, a first guide member 22 and a second guide member 23 may comprise plate members extending in the X-axis direction, and may be supported by a right side wall 21*a* and a left side wall 21*b*, respectively, of a main frame 21. The carriage 5 may be positioned on the first guide member 21*a* and the second guide member 21*b*, and may be configured to slide thereon. A timing belt 25, e.g., an endless timing belt, and a carriage motor 24, e.g., a DC motor, a stepping motor, or the like, for driving the timing belt 25 may be configured to reciprocate the carriage 5. The timing belt 25 may be wounded around a plurality of pulleys to stretch over and along an upper surface of the second guide member 23. A platen 26 may be positioned below the recording head 4 to support the conveyed recording medium P. An encoder strip 47 may extend along the X-axis direction of the carriage 5, and encoder strip 47 may be a portion of an optical linear encoder for detecting the position and the moving speed of the carriage 5 in the X-axis direction.

A pair of registration rollers 27 may be positioned upstream of the platen 26 in the sheet conveying direction, as shown by as arrow A in FIGS. 2 and 3, to convey the recording medium P into a gap between the nozzle surface of the recording head 4 and the platen 26. Spur rollers 28*b* and a discharge roller 28*a* may be positioned downstream of the platen 26. The discharge roller 28*a* may convey the recording medium P onto which an image has been recorded to the discharge portion 10 while the spur rollers 28*b* contact the upper surface of the recording medium P.

Referring to FIGS. 1 and 3, an ink receiving portion 29 may be positioned on one outer side of the width of the conveyed recording medium P adjacent to left side wall 12*a*. A maintenance unit 30 may be positioned on the other outer side of the width of the conveyed recording medium P adjacent to right side wall 21*b*. Ink is discharged periodically from the recording head 4 during recording operations at a flashing position in the ink receiving portion 29 to prevent the nozzles from becoming clogged by ink. The ink receiving portion 29 receives the discharged ink. The maintenance unit 30 may restore the recording head 4, located at a standby position, to a normal state by selectively drawing inks of different colors, or by eliminating bubbles trapped in buffer tanks (not shown) above the recording head 4. In addition, the maintenance unit 30 may comprise a wiper (not shown) which is configured to clean the nozzle surface of the recording head 4 when the carriage 5 moves from a position facing the maintenance unit 30 to an image recording area.

The cartridge storing unit 15 includes a case for storing ink cartridges (not shown). For example, the cartridge storing unit may be configured to store ink cartridges which comprise different color inks, e.g., each ink cartridge may store a different color ink corresponding to black ink, cyan ink, magenta ink, and yellow ink, respectively. The ink cartridges may be aligned in a row along the X-axis direction. Moreover, a plurality of flexible ink tubes 20 may be connected to cartridge storing unit 15 and to carriage 5, to provide ink therebetween.

Figure 4:
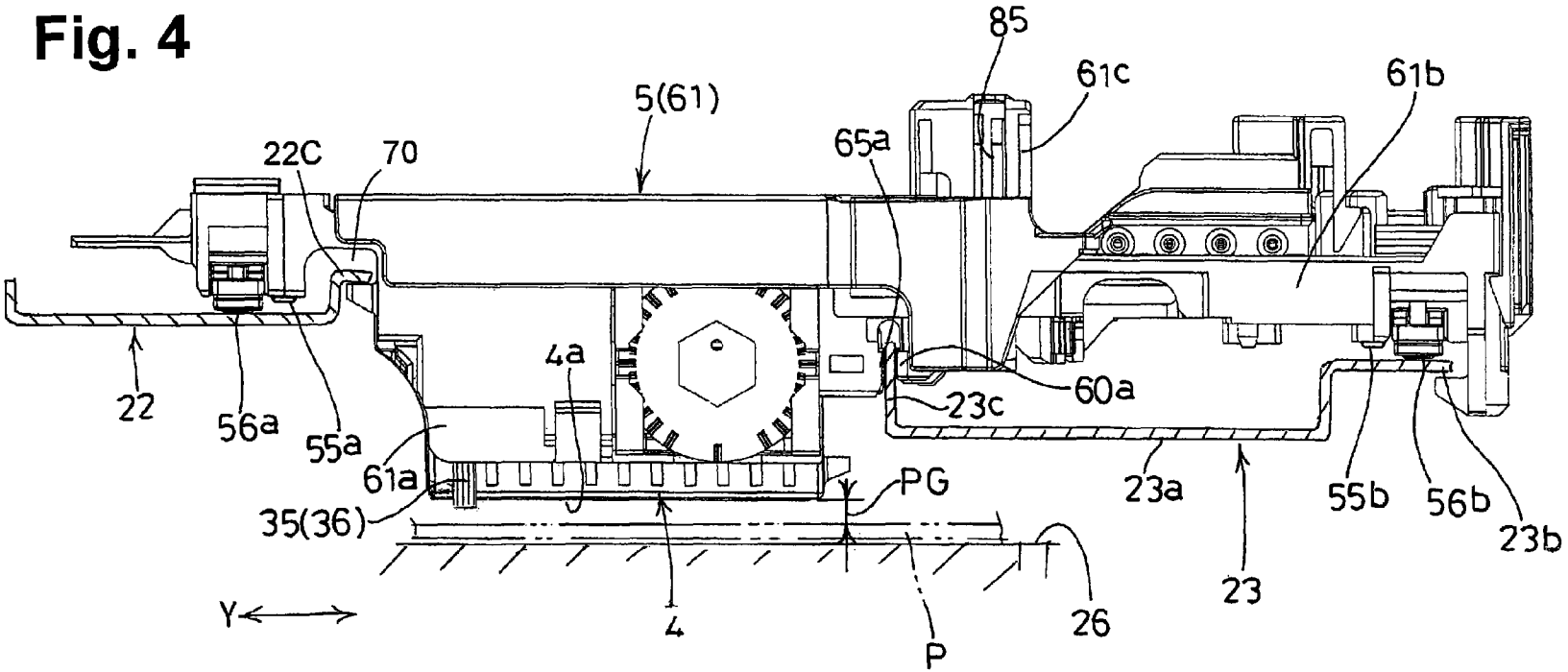
FIG. 4 is a side view of the carriage as viewed along line IV-IV in FIG. 3, in which a brush is separated from a recording medium.

With respect to the recording unit 7 and the carriage 5, the first guide member 22 and the second guide member 23 may be positioned upstream and downstream, respectively, in the sheet conveying direction. The first guide member 22 and the second guide member 23 may be positioned substantially horizontally. Referring to FIGS. 3 and 4, the first guide member 22 may comprise a flat plate 22*a* and a projecting piece 22*b*. For example, the flat plate 22*a* and the projecting piece 22*b* may be integral with the first guide member 22. The flat plate 22*a* may have a first sliding surface 51 on which an upstream portion of the carriage 5 in the sheet conveying direction is supported, such that the carriage may slide horizontally. The projecting piece 22*b* may have a Z-shape, and may be fitted into a recess 70 formed at an upstream portion of a holder 61.

Referring to FIGS. 3 and 4, the second guide member 23 may comprise a broad plate 23*a*, a flat plate 23*b*, and a guide piece 23*c*. The broad plate 23*a* may be a reference plane in a vertical direction for mounting the timing belt 2, carriage motor 24, and tape scale 47. The flat plate 23*b* may be positioned downstream of the broad plate 23*a* in the sheet conveying direction, and may have a second sliding surface on which a downstream portion of the carriage 5 is supported. The guide piece 23*d* may be located upstream of the broad plate 23*a*, and may stand upright.

The first sliding surface 51 may be positioned on an upper surface of the first guide member 22, and the second sliding surface 52 may be positioned on an upper surface of the second guide member 23. The first sliding surface 51 and the second sliding surface 52 may be parallel to the nozzle surface 4*a* of the recording head 4. Referring to FIG. 3, the guide piece 23*c* may have a third sliding surface 54 which faces downstream in the sheet conveying direction. Each of the first sliding surface 51, the second sliding surface 52, and third sliding surface 53 may extend linearly in the X-axis direction.

Figure 5:
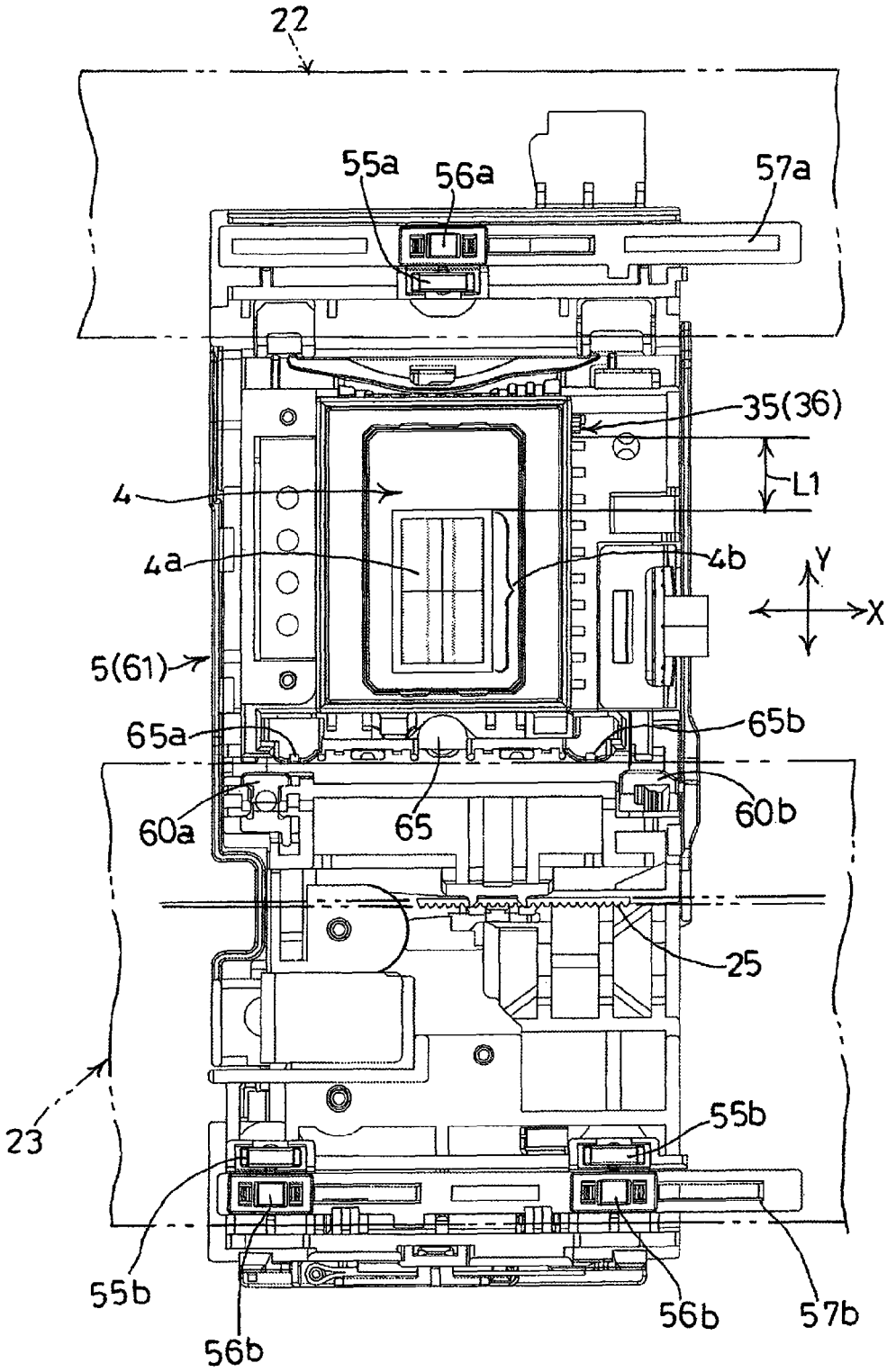
FIG. 5 is a bottom view of the carriage of FIG. 4.
Figure 6:
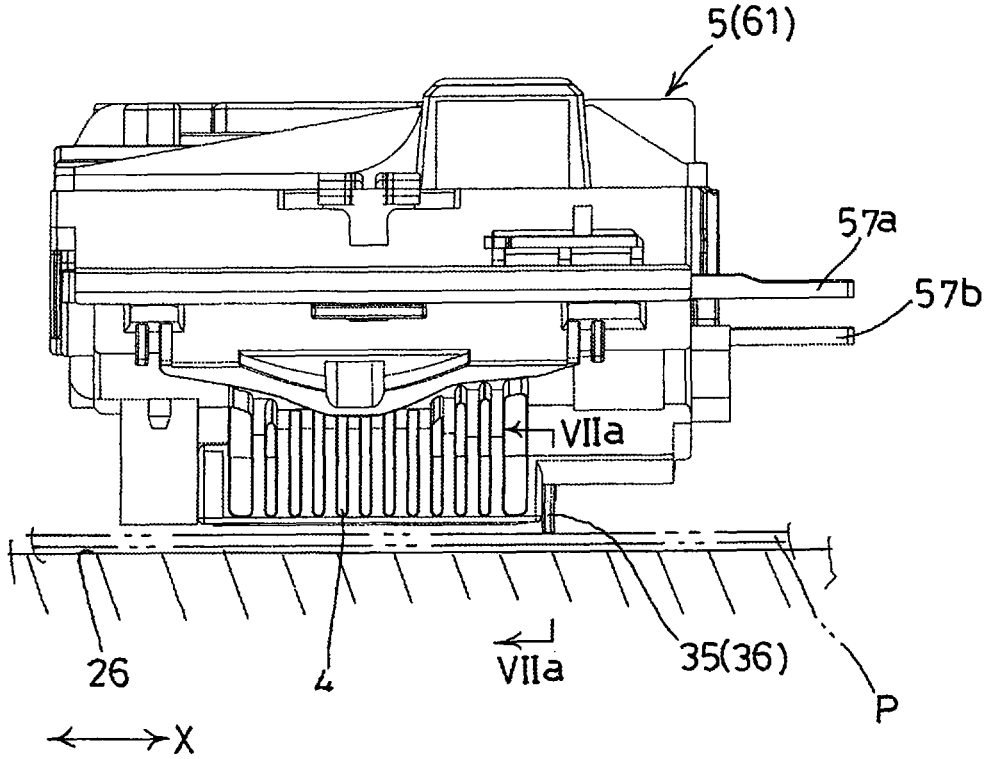
FIG. 6 is a front view of the carriage of FIG. 4, in which the brush is in contact with the recording medium.

Referring to FIGS. 3-5, the carriage 5 may comprise a holder 61 which has a substantially rectangular shape and comprises a synthetic resin. A head storing portion 61*a* having a relatively large height may be formed at an upstream portion of the holder 61, such that the recording head 4 is stored at a lower side of the holder 61. At a downstream portion of the holder 61, ink passages (not shown), a cable connector 61*b*, and a guide groove 85 may be integrally formed with the holder 61. The ink tubes 20 may be connected horizontally to the ink passages, such that ink is supplied via the ink passages to the recording head 4. A flexible flat cable 40 may be connected to the cable connector. The encoder strip 47 may pass through the guide groove 85, such that a light transmission type sensor, e.g. photo coupler 61*c*, detects the position and the moving speed of the carriage 5.

Referring to FIG. 5, a first projection 55*a* may be positioned at an upstream portion of the holder 61 in the sheet conveying direction and at the center of the holder 61 in the X-axis direction. The first projection 55*a* projects downward from the lower surface of the holder 61 and contacts the first sliding surface 51 of the first guide member 22.

A pair of second projections 55*b* is may be positioned at a downstream portion of the holder 61 symmetrically on the right and left sides of the holder 61. The second projections 55*b* project downward from the lower surface of the holder 61 and contact the second sliding surface 52 of the second guide member 23. For example, a shape formed by a line connecting each center of the first projections 61 and the second projections 55*b* may be an isosceles triangle, and the carriage 5 may be stably supported by the first guide member 22 and the second guide member 23.

Referring to FIGS. 4 and 5, a first auxiliary projection 56*a* may be positioned adjacent to the first projection 55*a*. A lower surface of the first projection 55*a* may be positioned lower than the first auxiliary projection when a distance, e.g., a paper gap PG, between the nozzle surface 4*a* and the platen 26 is adjusted to be greater than the distance between the nozzle surface 4*a* and the platen 26 when the first projection 55*a* contacts the first sliding surface 51. Similarly, the second auxiliary projections 56*b* may be positioned adjacent to the second projections 55*b*. The lower surfaces of the second projections 56*b* may be positioned lower than the second auxiliary projections when a distance, e.g., the paper gap PG, between the nozzle surface 4*a* and the platen 26 is adjusted to be greater than the distance between the nozzle surface 4*a* and the platen 26 when the second projections 55*b* contact the second sliding surface 52.

Referring to FIGS. 3 and 4, the carriage 5 may comprise a gap adjusting mechanism. The gap adjusting mechanism may comprise a pair of adjusting pieces 57*a* and 57*b*, and an elevating mechanism configured to move the first auxiliary projection 56*a* and the second auxiliary projections 56*b* in an upward and downward direction. The adjusting pieces 57*a* and 57*b* may be configured to move and to reciprocate in the X-axis direction, and to project from and to retract into the right and left sides of the carriage 5. Upright pieces 22*b* may be positioned at both ends of the first guide member 22 in the X-axis direction, and may be positioned at both ends of the second guide member 23. The elevating mechanism may be configured to move the first auxiliary projection 56*a* and the second auxiliary projection 56*b* in the upward and downward direction with respect to the first projection 55*a* and the second projections 56*b*, respectively, when the adjusting pieces 57*a* and 57*b* contact one of the upright pieces 22*b* and one of the upright pieces 23*d*, respectively, when the carriage 5 moves to the opposite moving ends in the X-axis direction. The gap adjusting mechanism may be similar to the gap adjusting mechanism disclosed in US2007/0122220A1, the disclosure of which is incorporated herein by reference in its entirety.

A pair of third projections 60*a* and 60*b* may be integral with the holder 61 and may contact the third sliding surface 54 of the second guide member 23. In addition, a pair of fourth projections 65*a* and 65*b* may be positioned in the holder 61 and may be positioned behind the guide piece 23*c*. The fourth projections 65*a* and 65*b* may be positioned at both ends of a pinching member 65, e.g., an elastic member comprising a synthetic resin, which may be elongated in the X-axis direction.

Referring to FIG. 4, the center of the pinching member 65 in the X-axis may be mounted to the holder 61, and a plurality of coil springs (not shown) may be positioned for the forth projections 65*a* and 65*b*. The guide piece 23*c* may be pinched by the pinching member 65 and the third projections 60*a* and 60*b* by an urging force of the coil springs.

In an embodiment of the present invention, the multi-function device 1 may comprise a cleaning unit 35. The cleaning unit 35 may be configured to remove debris, such as dust, e.g., a recording medium powder, from the surface of the recording medium P before an image is recorded on the recording medium P, such that the image more readily may adhere to the recording medium after ink is ejected onto the recording medium.

In an embodiment, the cleaning unit 35 may be positioned on the lower surface of the holder 61 at a position away from an ink ejecting portion 4*b* of the recording head 4 toward the upstream side in the sheet conveying direction, e.g., by a distance L1. The cleaning unit 35 may comprise a cleaning member.

The nozzle arrays may be arranged at predetermined intervals in the X-axis direction in the ink ejecting portion 4*b*. Each nozzle array may be configured to eject ink of a particular, predetermined color, may extend in the Y-axis direction.

Figure 7A:
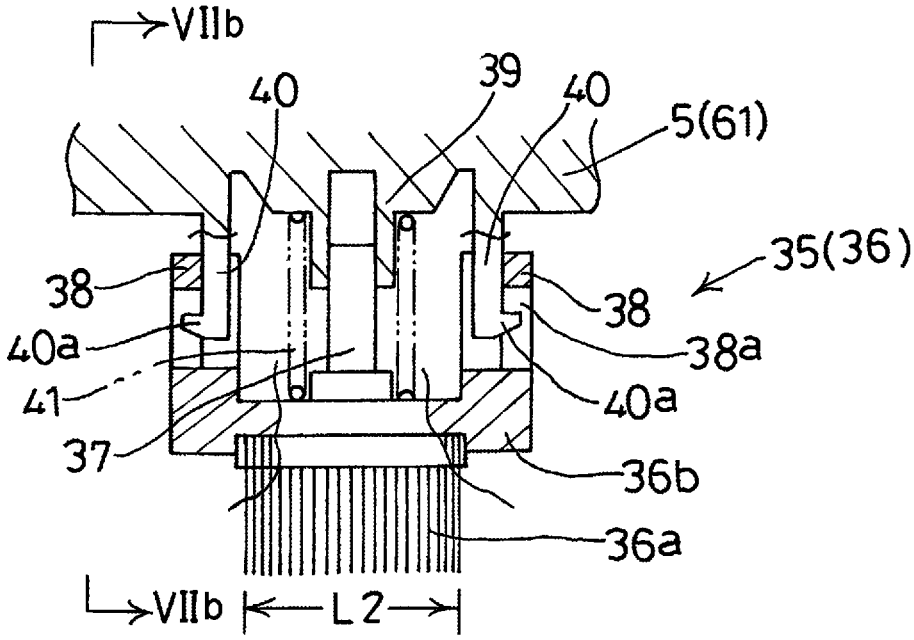
FIG. 7A is an enlarged view of the brush as viewed along line VIIa-VIIa in FIG. 6.
Figure 7B:
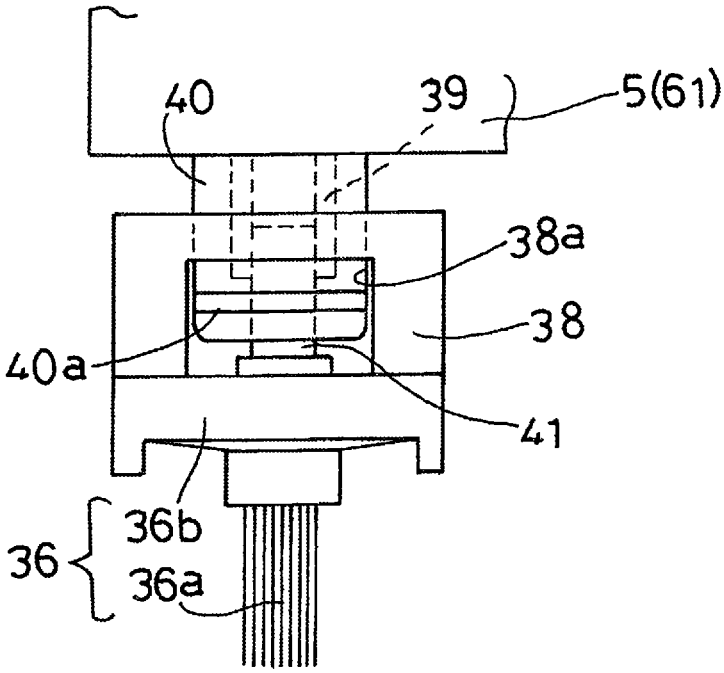
FIG. 7B is a view along line VIIb-VIIb in FIG. 7A.
Figure 8:
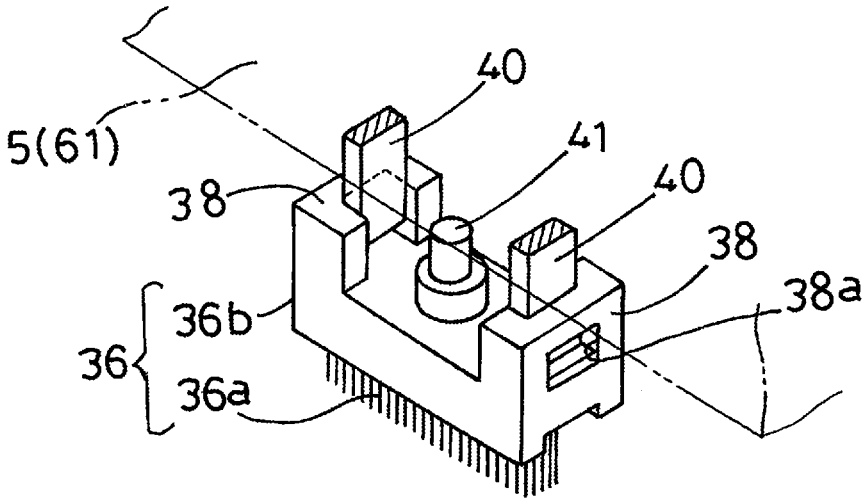
FIG. 8 is a partially cutout perspective view of the brush of FIGS. 4, 6, and 7A.
Figure 9A:
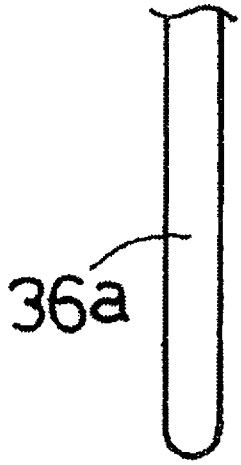
FIGS. 9A-9D are views showing an end shape of the brush of FIGS. 4, 6, and 7A.
Figure 9B:
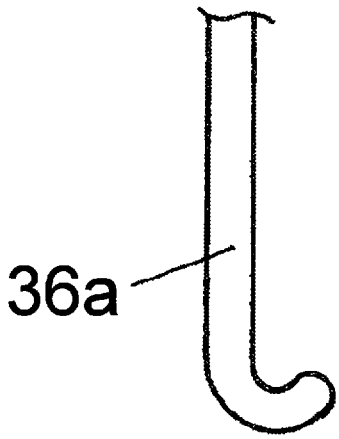
Figure 9C:
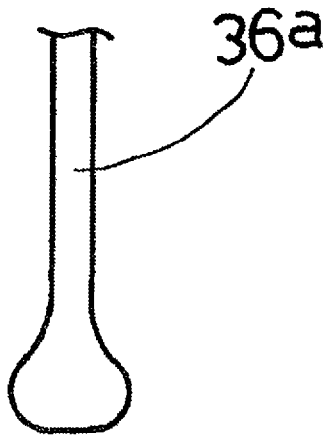
Figure 9D:
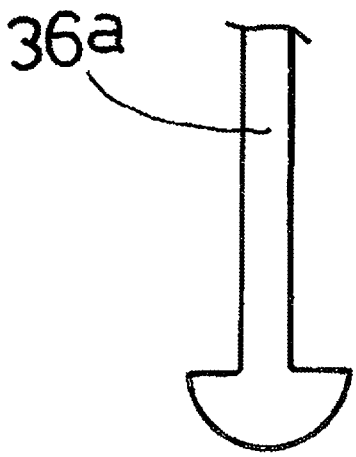

In this embodiment, the cleaning member may comprise a brush member 36. Referring to FIGS. 4-8, the brush member 36 may comprise a plurality of fibers 36*a*, e.g., straight fibers, implanted in a base plate 36*a*. Referring to FIGS. 7A and 7B, at least a portion of the plurality of fibers 36 may have a rectangular shape which is longer in the Y-axis direction than in the X-axis direction. A guide shaft 37 configured to guide the brush member 36 in vertical direction, e.g., along a Z-axis, and a pair of restricting frames 38 configured to restrict a range of vertical movement of the brush member 36 may be integral with the base plate 36*b*. A guide cylinder 39 and a pair of restricting members 40 may project from the lower surface of the carriage 5. The guide shaft 37 may be fitted into the guide cylinder 39, and may be configured to slide vertically. Each of the restricting members 40 may have a lug 40*a* which is fitted into a restricting hole 38*a* of a corresponding restricting frame 38, and may be configured to slide vertically. Springs 41 may be positioned between the base plate 36*b* and the lower surface of the carriage 5 at the periphery of the guide shaft 37 and the guide cylinder 39. Alternatively, a spring which is formed integrally with the base plate 36*b* projects from the upper surface of the base plate 36*b* and applies a force to the lower surface of the carriage 5 may be used.

A vertical dimension of the restricting hole 38*a* may be selected, such that the brush member 36 of the cleaning unit 35 only is sliding contact with the surface of the recording medium P when the distance, e.g., paper gap PG, between the nozzle surface 4*a* of the recording head 4 and the recording medium P is less than a predetermined distance.

In an embodiment of the present invention, for example when the image recording device records a high-quality image, such as a photograph image, using a glossy recording medium which is thicker than a standard recording medium, the paper gap PG may be adjusted to be less than the predetermined distance by moving the actuating pieces 57*a* and 57*b* in one of opposite directions in the X-axis direction, such that the first projection 55*a* contacts the first sliding surface 51, and the second projections 55*b* contact the second sliding surface 52.

In this embodiment, when the image recording device is instructed to record a high-quality image, the carriage 5 moves to one of the right and left ends of the main frame 21, and the actuating pieces 57*a* and 57*b* may be pressed by the upright pieces 22*b* and 23*d*, respectively, to move in one of the opposite directions along the X-axis direction, and to thereby to reduce the paper gap PG. Subsequently, when the carriage 5 reciprocates in the X-axis direction and the recording medium P is conveyed in the sheet conveying direction, the end of the brush member 36 slidably may contact the surface of the recording medium P at a position more upstream of the image recording area in the sheet conveying direction, such that the brush member 36 may remove debris from the recording medium P. Consequently, a more high-quality image may be recorded on the recording medium than with known image recording devices. In addition, because the brush member 36 is positioned away from the ink ejecting portion 4*b* by the distance L1, even when the end of the brush member 36 spreads while being pressed against the recording medium P, the brush member 36 may not interfere with the nozzles.

Moreover, in this embodiment, the springs may urge the brush member 36 downward, and the guide shaft may be vertically slidable with respect to the guide cylinder 39. The restricting members 40 may be vertically, slidably fitted into the restricting holes 38*a*. This configuration allows the brush member 36 to advance and to retract with respect to the surface of the recording medium P, while at the same time, contact the surface of the recording medium P. Accordingly, a pressing force applied by the brush member 36 to the recording medium P may be maintained at a constant value when the ends of the fibers 36*a* of the brush member 36 slidably contact the surface of the recording medium P. Thus, the brush member removes debris from the surface of the recording medium P, i.e., cleans the surface of the recording medium P, e.g., a glossy recording medium, with the constant pressing force. Moreover, the pressing force may be a pressing force which does not cause the ends of the fibers 36*a* to alter, e.g., damage, the surface of the recording medium P.

In this embodiment, a length L2 in the Y-axis of the brush member 36 which contacts the surface of the recording medium P may be a predetermined length. The length L2 may be greater than a line feed length in the Y-axis direction, and also may be less than twice the line feed length. Accordingly, an area of the recording medium P corresponding to at least the next line is reliably cleaned. In addition, the pressing force of the brush member 36 against the recording medium P may be less than force which may result in the carriage 5 floating due to a repulsion to the pressing force of the brush member 36, which may result in recording medium P skewing.

Referring to FIG. 4, when the paper gap PG is relatively large, and the first auxiliary projection 56*a* is in contact with the first sliding surface 51 and the second auxiliary projections 56*b* are in contact with the second sliding surface 52, the lug 40*a* of the restricting member 40 contacts the upper end of the restricting hole 38*a*, which prevents the brush member 36 from further descending. Thus, the ends of the fibers 36*a* do not contact the surface of the recording medium P, and a clearance is created therebetween.

When text recording, which may not require high-quality image recording, is performed, the paper gap PG may be selectively to be relatively large, and the brush member 36 may be positioned away from the surface of the recording medium P. Accordingly, the brush member 36 may be free from wear and the durability of the cleaning unit 35 is improved.

Alternatively, or in combination with the above-described embodiments, the cleaning member of cleaning unit 35 may comprise a roller member having a circumference which is covered with hairs e.g., short hairs, or a fiber mesh. In this embodiment, a brake mechanism may be provided. Such a brake member may reduce the peripheral speed of the roller member to be less than, e.g., slightly less than, the moving speed of the carriage 5 when a cleaning surface of the roller member is in contact with the surface of the recording medium P. In this embodiment, the cleaning member also may comprise a restricting unit which allows the cleaning surface of the roller member to contact the recording medium P only when the paper gap PG is relatively small, and a relief unit which prevents the pressing force of the roller member from becoming greater than a predetermined force.

In an embodiment, an end of the fiber 36*a* of the brush member 36 or an end of the fiber implanted in the roller member may be formed into a convex curved shape, which may facilitate the brush member 36 not damaging the surface of the recording medium P, such as a glossy recording medium P.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the following claims.

What is claimed is:

1. An image recording device comprising:

a recording head comprising a nozzle surface formed with a plurality of nozzles configured to dispense ink onto a recording medium;

a conveying unit configured to convey the recording medium to the recording head in a sub-scanning direction;

a platen configured to support the recording medium conveyed by the conveying unit;

a carriage configured to reciprocate across the platen in a main scanning direction perpendicular to the sub-scanning direction and comprising a protruding portion, wherein the recording head is positioned on the carriage such that the nozzle surface is enclosed by the protruding portion and the recording head moves with the carriage;

a maintenance unit configured to clean the nozzle surface of the recording head when the recording head is in a standby position outside of one side of the platen in the main scanning direction; and a cleaning unit configured to move with the carriage in the main scanning direction and comprising a cleaning member selectively positioned in a first position in which the cleaning member is in contact with a surface of the recording medium, or a second position in which the cleaning member is separated from the surface of the recording medium, wherein the cleaning member of the cleaning unit comprises an upstream end and a downstream end in the sub-scanning direction, and the cleaning unit is coupled to the carriage at a position, such that both the upstream end and the downstream end of the cleaning member are disposed more upstream in the sub-scanning direction than each of the plurality of nozzles of the recording head positioned on the carriage, such that both the upstream end and the downstream end of the cleaning member slide along and clean the surface of the recording medium in the main scanning direction perpendicular to the sub-scanning direction when the cleaning member is in the first position, wherein the cleaning member of the cleaning unit is disposed at a corner portion of the protruding portion of the carriage, and wherein, when the recording head is in the standby position, the corner portion is closer to the platen than the plurality of nozzles are to the platen, and the corner portion is positioned upstream from the plurality of nozzles in the sub-scanning direction.

2. The image recording device of claim 1, wherein the cleaning member is in the first position when a distance between the nozzle surface of the recording head and the surface of the recording medium is less than a predetermined distance.

3. The image recording device of claim 1, further comprising a gap adjusting mechanism configured to adjust a distance between the nozzle surface of the recording head and the surface of the recording medium between a first distance and a second distance which is greater than the first distance, wherein the cleaning member is in the first position when the distance between the nozzle surface of the recording head and the surface of the recording medium is equal to the first distance, and the cleaning member is in the second position when the distance between the nozzle surface of the recording head and the surface of the recording medium is equal to the second distance.

4. The image recording device of claim 3, wherein the gap adjusting mechanism is configured to move the carriage vertically with respect to the surface of the recording medium, and the cleaning member is positioned at a lower surface of the carriage.

5. The image recording device of claim 1, wherein the cleaning member is configured to advance and to retract with respect to the recording medium, and to maintain contact with and to apply a substantially constant force to the surface of the recording medium when the cleaning member advances and retracts with respect to the recording medium.

6. The image recording device of claim 5, wherein the constant force is force which is less an amount of force which would alter the surface of the recording medium when the cleaning member advances and retracts with respect to the recording medium.

7. The image recording device of claim 1, wherein a length of the cleaning member in the sub-scanning direction is greater than a line feed length of the recording medium in the sub-scanning direction, and is less than twice the line feed length of the recording medium in the sub-scanning direction.

8. The image recording device of claim 1, further comprising:

a first guide member; and a second guide member, wherein the carriage is configured to slide on each of the first guide member and the second guide member when the carriage reciprocates in the main scanning direction, wherein the first guide member is positioned upstream of the platen in the sub-scanning direction, and the second guide member is positioned downstream of the platen in the sub-scanning direction.

9. The image recording device of claim 8, wherein the first guide member has an upper surface which extends substantially horizontally and defines a first sliding surface, and the second guide member has an upper surface which extends substantially horizontally and defines a second sliding surface, wherein the carriage comprises:

a first projection; and a second projection, wherein the first projection and the second projection extend from a lower surface of the carriage, and the cleaning member contacts the surface of the recording medium when the first projection contacts the first sliding surface and the second projection contacts the second sliding surface.

10. The image recording device of claim 9, wherein the carriage comprises:

a first auxiliary projection; and a second auxiliary projection, wherein the first auxiliary projection and the second auxiliary projection extend further from the lower surface of the carriage than the first projection and the second projection extend from the lower surface of the carriage, respectively, wherein the cleaning member moves away from the surface of the recording medium when the first auxiliary projection contacts the first sliding surface and the second auxiliary projection contacts the second sliding surface.

11. The image recording device of claim 1, wherein the cleaning member comprises a brush member comprising a plurality of fibers, and ends of the plurality of fibers have a convex curbed shape and contact the surface of the recording medium when the cleaning member is in the first position.

* * * * *